US005095928A

United States Patent [19]

Phipps

[11] Patent Number: 5,095,928

[45] Date of Patent: Mar. 17, 1992

[54] PAINT ROLLER CLEANING DEVICE

[76] Inventor: William A. Phipps, 1000 E. Palmcroft Dr., Tempe, Ariz. 85282

[21] Appl. No.: 618,493

[22] Filed: Nov. 27, 1990

[51] Int. Cl.[5] ..... B08B 3/02

[52] U.S. Cl. ..... 134/138; 134/153; 134/200; 134/900

[58] Field of Search ..... 134/138, 153, 149, 151, 134/154, 198, 200, 900

[56] References Cited

U.S. PATENT DOCUMENTS

| | | | |
|---|---|---|---|
| 2,831,488 | 4/1958 | Anderson | 134/138 |
| 2,985,178 | 5/1961 | Christensen, Jr. | 134/900 X |
| 3,075,534 | 1/1963 | Habostat | 134/138 |
| 3,133,548 | 5/1969 | Carr | 134/138 |
| 3,421,527 | 1/1969 | Dettman | 134/900 X |
| 3,577,280 | 5/1971 | George | 134/138 |
| 3,730,195 | 5/1973 | Kay | 134/900 X |
| 3,886,960 | 6/1975 | Krueger | 134/138 |
| 4,108,189 | 8/1978 | Claiborne et al. | 134/900 |
| 4,402,333 | 9/1983 | Frizzell et al. | 134/138 |
| 4,672,987 | 6/1987 | Brandt | 134/138 |
| 4,711,258 | 12/1987 | Rossborough et al. | 134/138 |
| 4,765,353 | 8/1988 | Rhoades | 68/213 |
| 4,809,722 | 3/1989 | Pennise . | |

*Primary Examiner*—Frankie L. Stinson

[57] ABSTRACT

A device for cleaning paint rollers (12) while part of an assembly (17) including a paint roller (12) on a roller holder (14) on a holder shaft (15) which has a handle (16). The device consists of a spray shield (26) which when detachably attached to a liquid manifold (24) houses a paint roller (12) to be cleaned. The liquid one piece manifold (24) has one or more integral slots (28) positioned parallel to the long dimension of the manifold (24) and the attached spray shield (26). The slots (28) receive the holder shaft (15) of the paint roller assembly (17). The liquid manifold (24) is fitted with a recessed (19) liquid inlet connector (18) for the induction of liquid into the manifold (24) for conveyance to a multitude of apertures which produce spray jets (20). The spray jets (20) impinge upon the full length of the paint roller (12). The spray jets (20) are positioned to pivotly force the holder shaft (15) into the shaft slot (28) for secure retention without additional attachment. The spray jets (20) are also positioned to cause rotation of the paint roller (12) which is cleaned by the washing of the liquid and the centrifugal forces of the rotation. The spray jets (20) are aerated (22) to reduce liquid splash. The spray shield (26) can be easily detaced from and wrapped around the liquid manifold (24) for storage or packaging.

12 Claims, 7 Drawing Sheets

PAINT ROLLER CLEANING DEVICE

FIELD OF INVENTION

This invention relates to a device for cleaning paint rollers.

BACKGROUND

One method of applying paint to a surface is to use a paint roller. Paint rollers are comprised of various thicknesses of fiber covered cylinders and are attached to a roller holder which rotates about a shaft which has a handle.

If the paint roller is to be salvaged for reuse it is necessary to thoroughly clean the paint material from the paint roller. A basic method of accomplishing the cleaning process is to immerse the paint roller, either while still attached to the roller holder or after it is removed from the roller holder, into a liquid and agitate the roller or its surface to dissolve the paint. Another basic method is to cause a liquid under pressure to spray upon the paint roller to dislodge the paint. These basic methods have various degrees of success in cleaning the paint roller dependent upon the perseverance and attention of the individual operator. These basic methods usually are very time consuming and messy for the operator, can result in incomplete cleaning of the paint roller and can cause damage to the operators apparel and the surrounding surfaces. It is very difficult to accomplish these basic cleaning methods anywhere other than out-of-doors, a situation which is not always desirable or available. The advantages of my invention include the thorough cleaning of different sizes of paint rollers while still attached to the handle in a device which is easy to set up, requires little attention by the operator, with a minimum of mess and cleanup in a location of the operators choice. Other advantages which will become apparent in later paragraphs are the result of the novelty and simplicity of my invention.

REVIEW OF PRIOR ART

Review of prior art discloses various apparatus to assist in the cleaning of paint rollers. Generally they include a housing into which a paint roller either on or removed from its handle is mounted and subjected to a spray of liquid for cleaning. U.S. Pat. No. 4,672,987 to Brandt describes a device for cleaning paint rollers while it is mounted on the roller holder and handle. The paint roller apparatus is inserted into a tubular housing and held in place in a slot in a cap which aligns the roller for rotation and cleansing by a fluid stream. The design of the cap is complex to manufacture and it is questionable that in time the slotted plate arrangement will hold the wet-weighted paint roller in place against the opposing pressure of the liquid spray. The essential use of the cap precludes use without a cap and disallows visual observation of the cleaning process during operation. The liquid tube requires machining, threading and adhering thus increasing the manufacturing and maintenance costs. The single position provided for the paint roller and the fixed fluid stream direction will not allow equal rotation capabilities of various paint roller diameters thus limiting the usefulness of the device.

U.S. Pat. No. 4,711,258 to Rossborough discloses an apparatus for cleaning a paint roller while it is mounted on the roller holder and handle. The Apparatus consists of a hollow cylindrical housing, a water outlet member, a locating clip for positioning the paint roller and three supporting legs. The mechanical action of inserting and removing the paint roller handle will have a deteriorating action on the holding clip device which appears complex to manufacture and maintain. The multitude of parts and supporting leg device makes the apparatus difficult to store without disassembly after use. The single positioning available for the paint roller and the liquid spray of this apparatus also limits the diameter of paint roller which can be efficiently cleaned.

U.S. Pat. No. 4,641,673 to Conley describes a device for cleaning paint rollers and brushes. The device comprises an open ended tubular housing which suggests a variety of configurations of water manifolds which deliver water to a paint roller. A multiple adjustment clamping means is employed to secure the paint roller in place for cleaning. The manifold construction and the clamping means are complicated and require excessive tooling, machining and attaching.

OBJECTS AND ADVANTAGES

Analysis of the problem of cleaning a paint roller leads to a set of requirements for a successful solution. This analysis occurs during the use of current cleaning processes, during the development of independent investigation of spontaneous ideas and continues on during the search for others thoughts and ideas and ultimately during the search of prior art and the marketplace. Therefore the objects of the present invention are as follows:

1 The device cleans the paint roller thoroughly.

2 The paint roller can be cleaned while still attached to the paint roller handle.

3 The device is capable of cleaning a variety of roller cover thicknesses.

4 The cleaning process is accomplished with limited attendance or manipulation of an operator.

5 The paint roller while on its handle is able to be placed into the cleaning device and be cleaned without the need of restraint by extraordinary means.

6 The operation is possible with control of extraneous liquid splash or dispersement.

7 The device is of simple design with a minimum of parts.

8 The device is easy to manufacture using common methods and materials.

9 The device has a minimum of moving parts.

10 The design of the device takes advantage of the natural physics of the materials and the action and proximities of its elements.

11 The device is usable in a variety of locations.

12 The device has stability during the cleaning operation.

13 Clean-up of the device itself is minimum and easy to accomplish.

LIST OF REFERENCE NUMBERS

Figure 1:
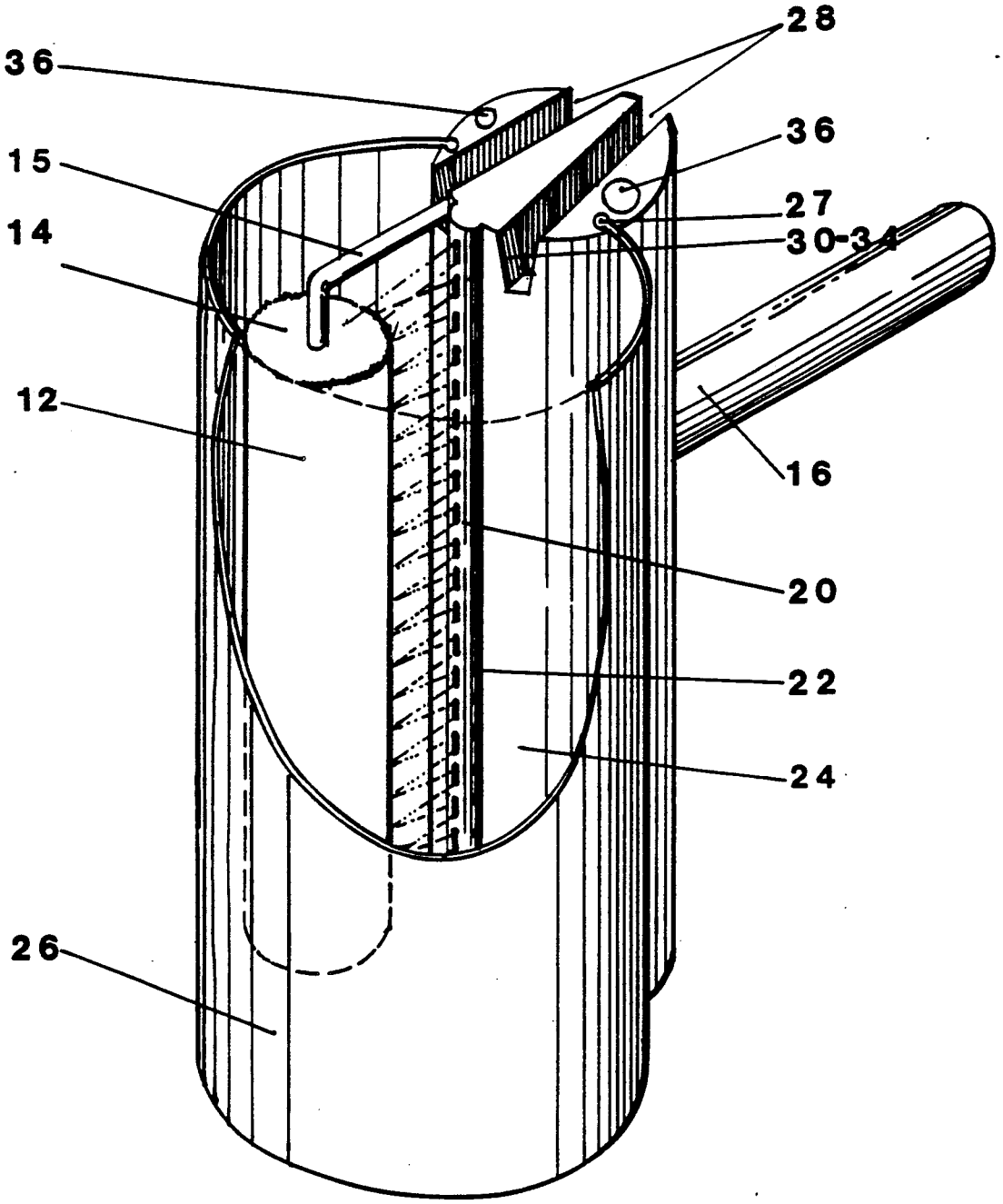
FIG. 1. An isometric view of the device with a portion of the spray shield shown cut-away to illustrate a paint roller in the cleaning position.

12 Paint Roller: Cylinders with various thickness of covering which are attached to a roller holder (14).

14 Roller Holder: Device which receives the paint roller (12) and allows rotation about the holder shaft (15).

15 Holder Shaft: Shaft device which receives and allows rotation of the roller holder (14).

16 Shaft Handle: Device attached to the holder shaft (15) for gripping the shaft of the paint roller assembly (17) by the operator of the device.

17 Paint Roller Assembly: Assembly comprised of a paint roller (12), a roller holder (14), a holder shaft (15), and a shaft handle (16).

18 Liquid Inlet Connector: Standard connecting device for the connector of the liquid manifold (24) to a suitable liquid source.

19 Inlet Recess: Configuration of the liquid manifold (24) at the location of the liquid inlet connector (18).

20 Liquid Spray Jet: Jet created by liquid being forced through an aperture located in the surface of the liquid manifold (24).

22. Liquid Spray Aerator: Apertures arranged to cause the introduction of air to the liquid spray jet (20).

23. Groove (23): Configuration of liquid manifold (24) as attachment means of the spray shield (26).

24 Liquid Manifold: Container which receives the liquid, conveys liquid to and dispenses liquid through the liquid spray jets (20), contains slots (28 & 30) to receive and hold a paint roller assembly (17) in an appropriate position for cleaning, and provides support for the spray shield (26) and cover (38).

25 Enlarged Edge: Configuration of the spray shield (26) as attachment means to the liquid manifold (24).

26 Spray Shield: Material configured to provide shield from liquid splash and containment of liquid prior to disposal thereof.

27 Spray Shield Attachment: Configuration of spray shield (26) and liquid manifold (24) to provide means of detachable attachment of the spray shield (26) to the liquid manifold (24).

28 Shaft Slot: Configuration located in the liquid manifold (24) to hold a paint roller assembly (17) in the correct position for cleaning the paint roller (12).

30 Pivot Slot: Configuration which connects the shaft slot (28) to the perimeter of the liquid manifold (24), and provides a pivot point (32) for the pivoting of the paint roller assembly (17).

32 Pivot Point: Location about which the paint roller assembly (17) pivots with the force created by the liquid spray jets (20) impingement upon the paint roller (12).

34 Wedge Shape: Means to allow the friction gripping of the holder shaft (15) when it is forced into a tapered shape.

36 Slot Indicator: Means of indicating the appropriate shaft slot (28) to be used for the size of paint roller (12) to be cleaned by the device.

38. Cover: Closure for the opening at the top of the spray shield (26) to assist in liquid spray containment.

40. Inspection Port: Aperture in the cover (38) for inspection of the cleaning process and to provide assistance in cover (38) removal.

41. Depression: Configuration of the bottom of the liquid manifold (24) to form the glide surface (42).

42. Glides: Bearing surface at the perimeter of the bottom of the liquid manifold (24).

DESCRIPTION OF INVENTION

FIG. 1 illustrates a paint roller 12 mounted on a roller holder 14 which rotates about a holder shaft 15 which has a shaft handle 16. The paint roller 12 is shown in the cleaning position with the holder shaft 15 having been placed into a handle slot 28 for smaller diameter paint rollers, said slot being an integral part of the liquid manifold 24. The holder shaft 15 is held in position also by being placed in the wedge shape 34 which forms a pivot point 30 about which the holder shaft 15 can pivot with the force of the liquid spray jets 20. The spray jets 20 with the addition of aeration 22 impinge liquid from the liquid manifold 24 upon the paint roller 12 at a location to cause the paint roller 12 to rotate about the holder shaft 16. The slot indicators 36 are placed to define the proper shaft slot 28 for the size of paint roller 12 to be cleaned. The removable spray shield 26 is attached to the liquid manifold 24 at the spray shield attachment 27 to form a shield to control the spray of liquid from the rotating paint roller 12. The cover 38 is not shown in this figure for clarity but can be seen in FIG. 2.

Figure 2:
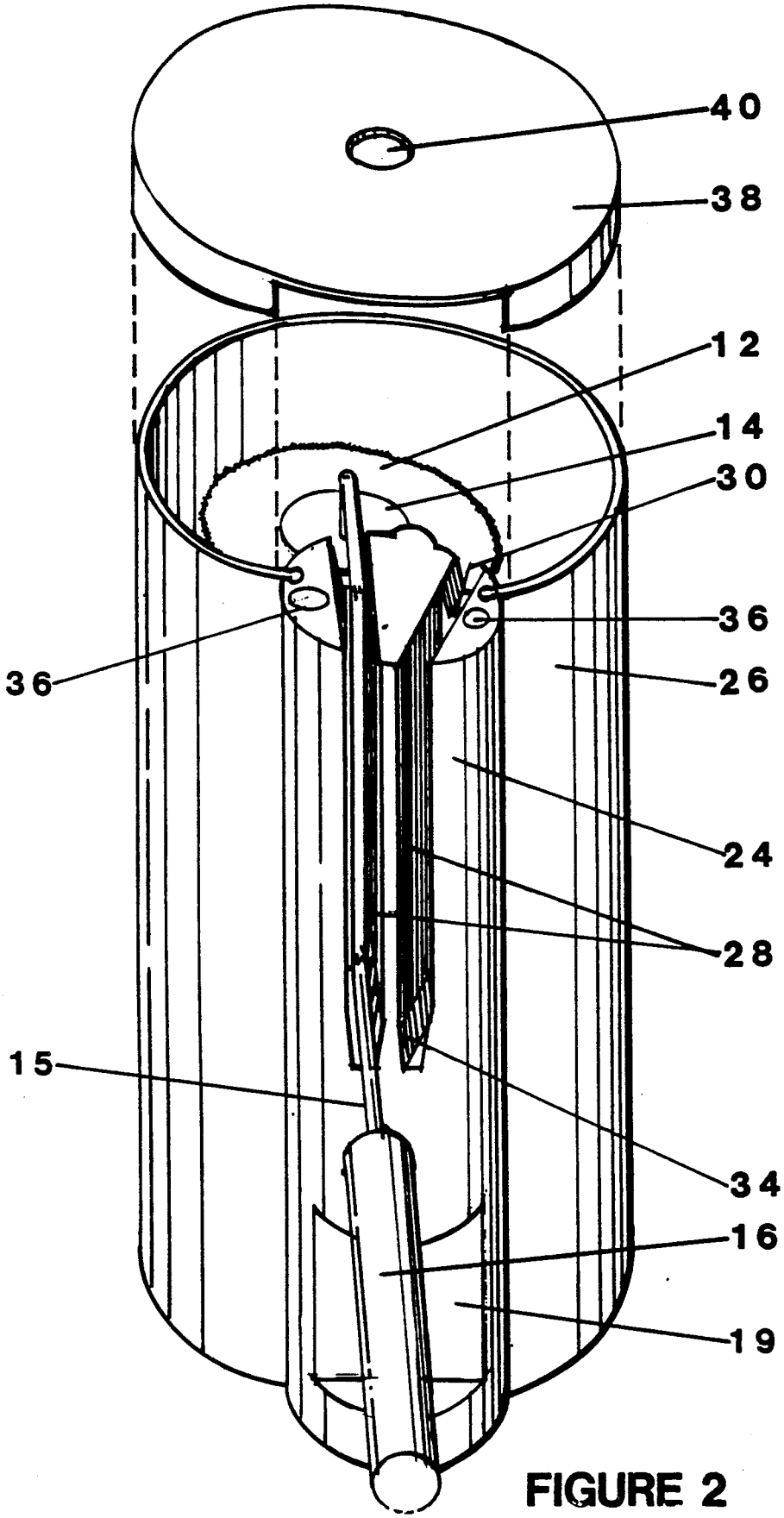
FIG. 2. An isometric view of the device looking at the shaft slot side of the device.

FIG. 2 is an isometric view of the device from another angle showing a larger diameter paint roller 12 on the roller holder 14 with the holder shaft 15 placed into the shaft slot 28 designated by the larger size slot indicator 36. The holder shaft 15 is held in proper cleaning position by the shaft slot 28 and the wedge shape 34 at the bottom of the shaft slot 28. The cover 38 is shown above the device for clarity and in operation would be placed on the top of the spray shield 26. The inspection port 40 is located in the cover 38 for visual observation of the paint rollers 12 in position while the cleaning process is occurring and the cover 38 is in place. The observation port serves also as a means of gripping the cover 38 in removing it from the device. The liquid inlet connector 18 is seen behind the shaft handle 16 and will be illustrated and described in other figures.

Figure 3:
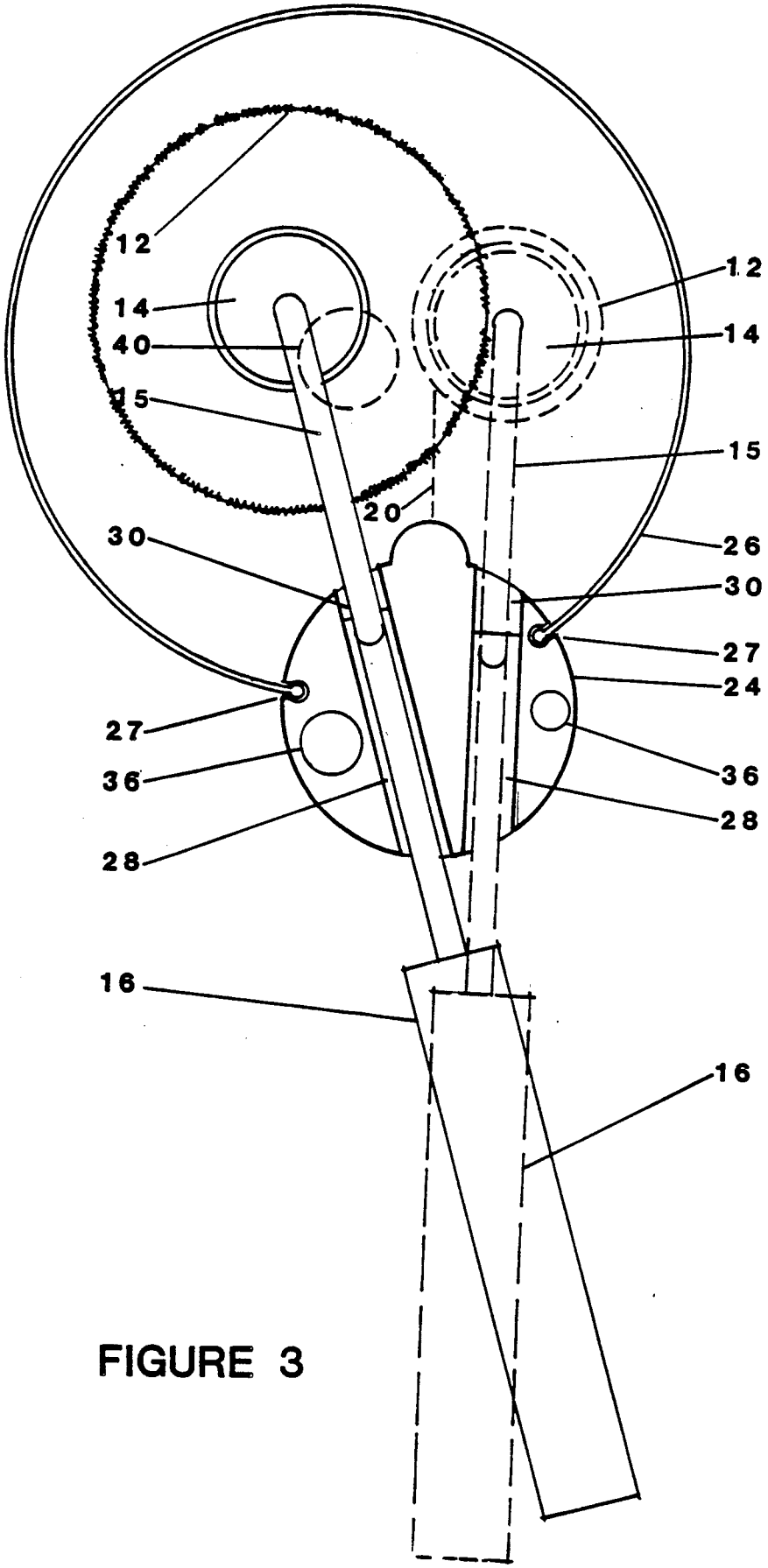
FIG. 3. A plan view of the device with paint roller shown in various cleaning positions.

FIG. 3 is a plan view of the top of the device with the cover 38 removed. Two sizes of paint rollers 12 are shown installed in the device, a larger size shown with solid lines and a smaller size shown with dash lines. The paint rollers 12 are shown on their roller holders 14 which are mounted on holder shafts 15 which have handles 16. The holder shafts are shown inserted into the shaft slot 28 appropriate for the diameter of the paint roller as indicated by the slot indicator 36 adjacent to the shaft slot 28. The location of the inspection port 40 in the cover 38 is shown in a position to observe the paint roller 12 in either paint roller 12 position. The spray shield 26 is shown in the installed position in the spray shield attachments 27 in the liquid manifold 24. A dashed line shows the liquid spray jet 20 which is located to correctly impinge the paint roller 12 causing rotation in either installed position.

Figure 4:
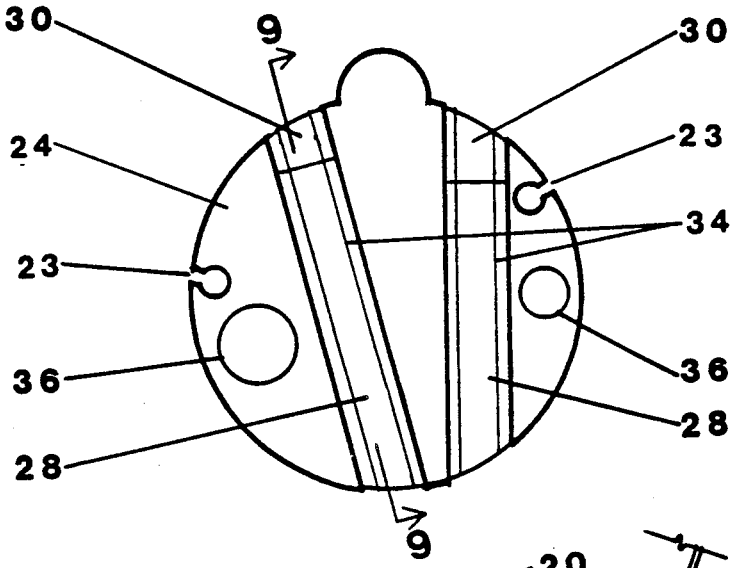
FIG. 4. A plan view of the top of the liquid manifold portion of the device.

FIG. 4 is a plan view of the top of the liquid manifold 24 and shows the top of the shaft slots 28 and the pivot slots 30. The slot indicators 36 are shown adjacent to the shaft slot 28 appropriate for the larger or smaller paint roller size. The spray shield attachment groove 23 is shown on either side of the liquid manifold 24 with the spray shield 26 removed.

Figure 5:
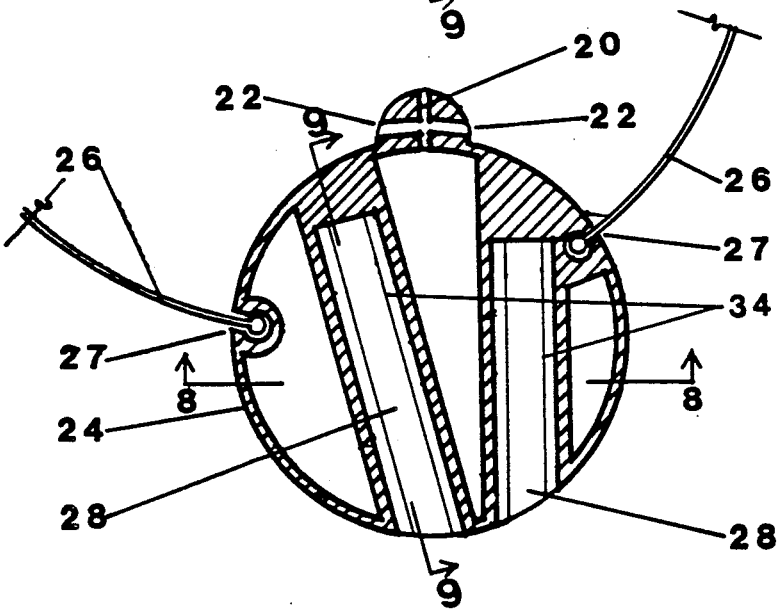
FIG. 5. A cross section at the shaft slot feature of the liquid manifold.

FIG. 5 (refer to FIG. 7 for location) is a cross section of the liquid manifold 24 through the shaft slots 28. A portion of the spray shield 26 is shown installed in the spray shield attachment 27. The section also shows the liquid spray jet aperture 20 and liquid spray aerators 22.

Figure 6:
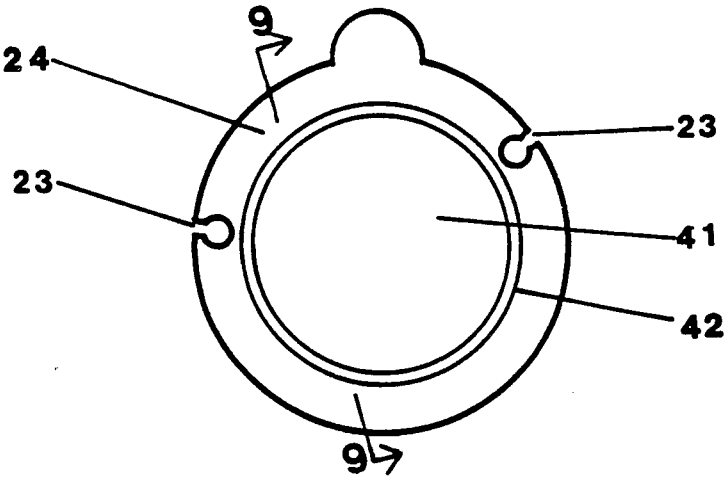
FIG. 6. A plan view of the bottom of the liquid manifold portion of the device.

FIG. 6 shows the bottom of the liquid manifold 24 indicating a depression which forms a continuous glide surface 42. The bottom of the spray shield attachment 27 is also shown on either side of the liquid manifold 24.

Figure 7:
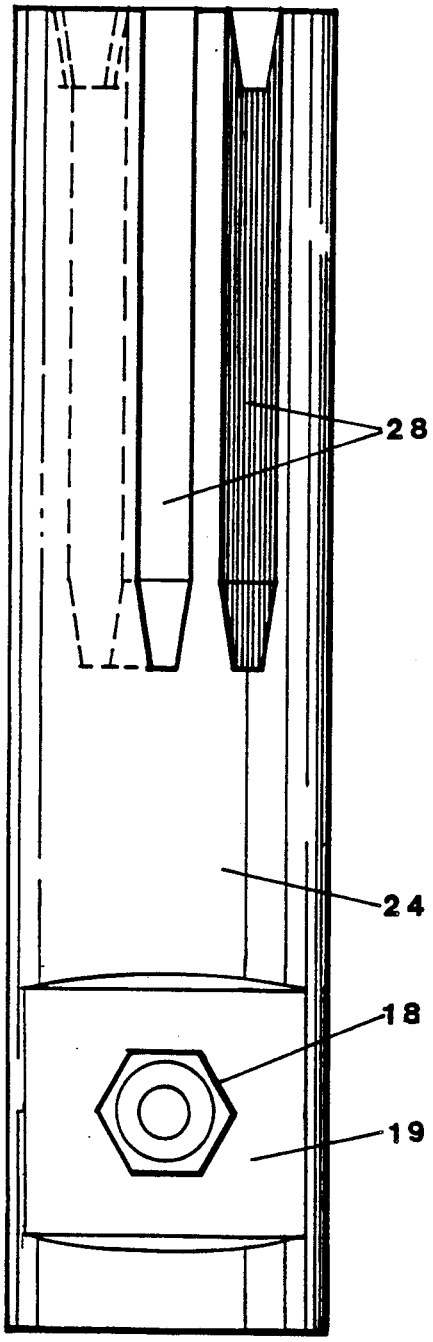
FIG. 7. An elevation of the shaft slot side of the liquid manifold portion of the device.

FIG. 7 is an elevation of the liquid manifold 24 showing the shaft slot 28 side. The liquid inlet connector 18 and the inlet recess 19 are also shown in elevation.

Figure 8:
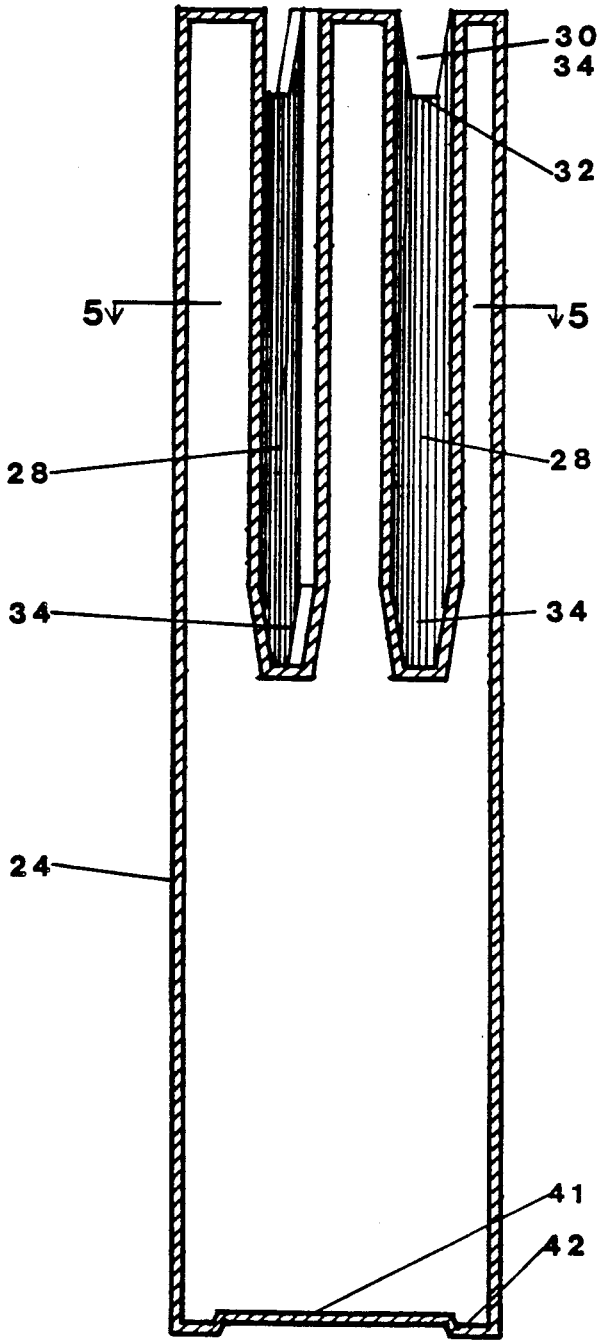
FIG. 8. A longitudinal section through the liquid manifold.

FIG. 8 (refer to FIG. 5 for location) is a longitudinal section through the liquid manifold 24. The shaft slots 28 are shown with the wedge shape configuration 34 at the bottom of the shaft slots 28. The pivot slots 30 with wedge shape configuration 34 are also shown at the top of the shaft slots 28. The pivot point 32 at the bottom of the pivot slots 30 is also noted. The recessed portion 19 of the liquid manifold 24 is shown receiving the liquid connector 18. At the bottom of the liquid manifold 24 is the depression 41 which forms the glide surface 42.

Figure 9:
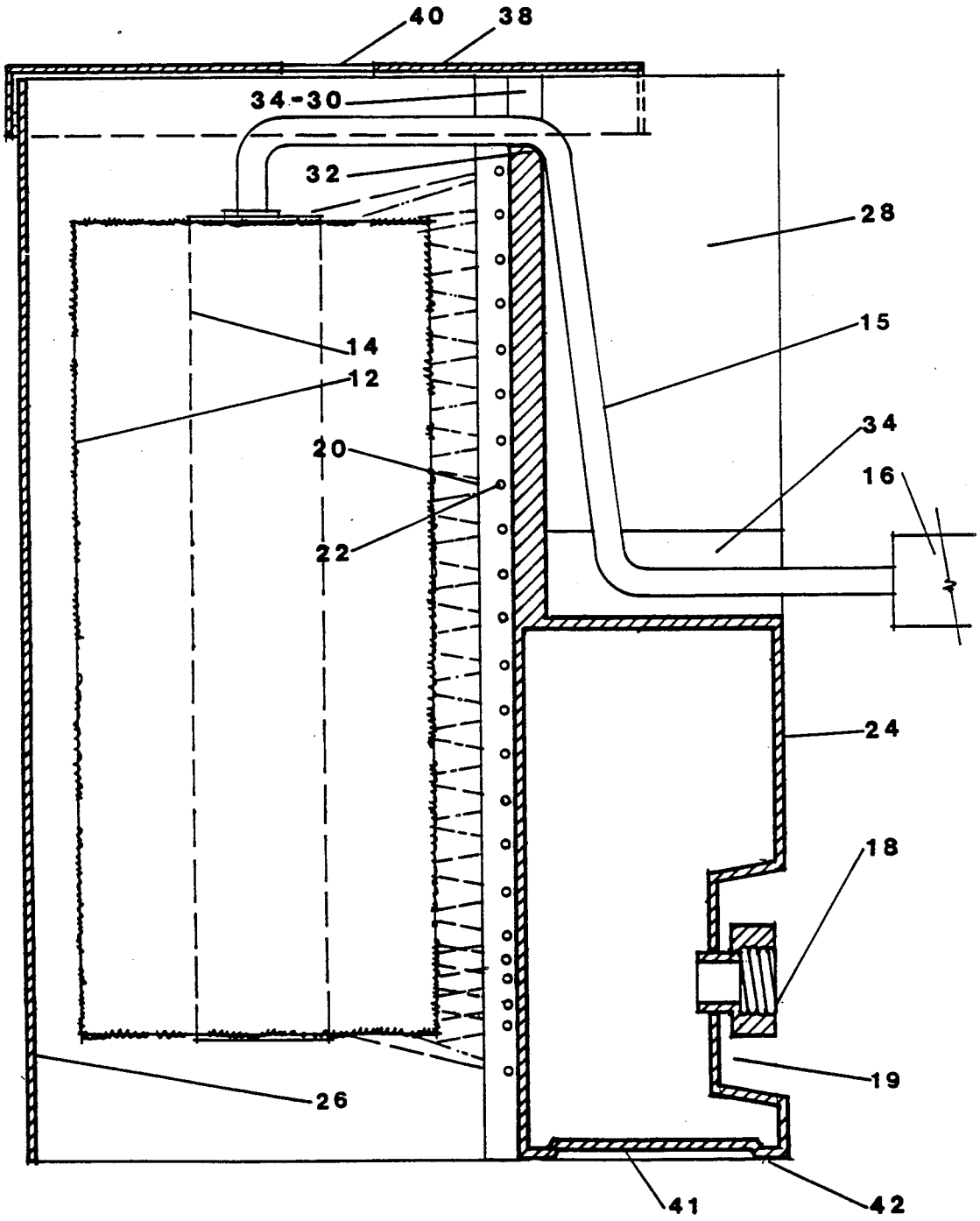
FIG. 9. A longitudinal section through the device with a paint roller assembly in the cleaning position.

FIG. 9 (refer to FIGS. 4, 5 and 6 for location) is a longitudinal section through the device showing a paint roller in the cleaning position. The paint roller 12 mounted on the roller holder 14 rotates about the holder shaft 15 which has a handle 16. The paint roller 12 is inserted into the spray shield 26 by placing the holder shaft 15 into the appropriate shaft slot 28. The top portion of the holder shaft 15 is received by the pivot slot 30 and guided into the proper position by the wedge shape 34 configuration of the pivot slot 30. The positioning of the liquid spray jets 20 causes the holder shaft 15 to pivot about the pivot point 32 located at the bottom of the pivot slot 30 wedge shape 34. The pivoting of the holder shaft 15 causes said shaft 15 to be forced into the wedge shape 34 at the bottom of the shaft slot 28. The paint roller 12 is consequently held firmly in position by gravity, leverage and friction thus requiring no other means of attachment during the cleaning process. The liquid spray jets 20 are located to cause the paint roller 12 to rotate at a high speed, to provide liquid contact with the entire surface of the paint roller 12 and the ends of the roller holder 14 and to cause pivoting of the paint roller holder shaft 15 about the pivot point 32. The liquid spray aerators 22 are shown at the liquid spray jet 20 locations. The liquid inlet connector 18 in the inlet recess 19 allows the introduction of the liquid into the liquid manifold 24 for distribution to the liquid spray jets 20. The cover 38 with its inspection port 40 is shown in place at the top of the spray shield 26. The depression 41 in the bottom of the liquid manifold 24 forms the glide surface 42.

Figure 10:
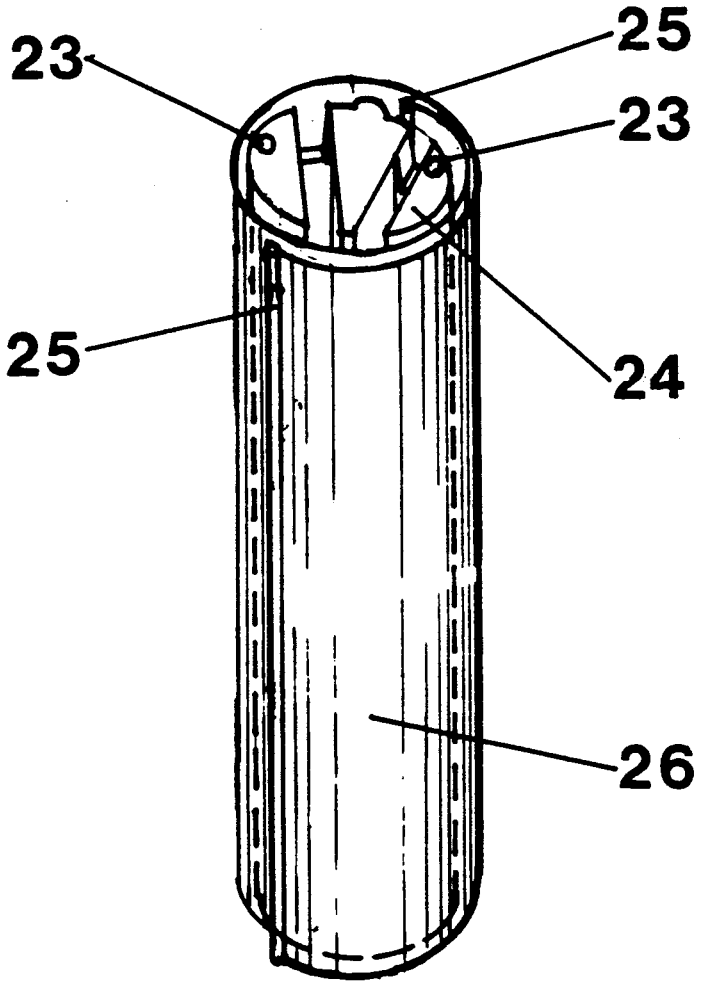
FIG. 10. An isometric view of the device illustrating the spray shield detached from and wrapped around the liquid manifold for storage.

FIG. 10 is an isometric view showing the spray shield 26 detached from and wrapped around the liquid manifold 24.

OPERATION OF THE INVENTION

Device Setup

Setup is accomplished by placing the device in a location suitable for the disposal of the used liquid and connection of the liquid inlet connection 18 to a liquid source. The spray shield 26 is attached to the liquid manifold 24 at the spray shield attachment means 27.

The weight added to the device by the introduction of the liquid into the liquid manifold 24 introduces a stability to the device during the cleaning operation.

Paint Roller Cleaning Process

The paint roller 12 while still attached to the roller holder 14 of the paint roller assembly 17 is inserted into the device before or after the liquid source is turned on. The holder shaft 15 is inserted into the shaft slot 28 indicated as appropriate for the roller size by the slot indicator 36. The force of the liquid spray jets 20 causes the holder shaft 15 to pivot about the pivot point 32 at the bottom of the pivot slot 30 thus holding the holder shaft 15 and the paint roller 12 in the correct position during the cleaning process. The wedged shaped configurations 34 of the bottom of the pivot slot 30 and the shaft slot 28 also assists in maintaining the correct paint roller 12 position.

The installation of the cover 38 reduces the splash onto adjacent surfaces while allowing observation through the inspection port 40.

The impingement of a multitude of liquid spray jets 20 upon the paint roller 12 causes cleaning actions including the washing and dissolving capabilities of the spray jet 20 itself and the dislodging actions of the centrifugal forces created. Directing of certain liquid spray jets 20 affords cleaning of the top and bottom of the paint roller 12 as well as the ends of the roller holder 14.

The aeration 22 of the liquid spray jets 20 is an application which reduces the amount of extraneous splash and appears to cause the liquid to "cling" to the roller where it can continue cleaning until forced away by centrifugal action.

SUMMARY AND SCOPE OF INVENTION

Thus it can be seen that the paint roller cleaning device of the invention provides a dependable, uncomplicated and economical device which can be used by amateur or professional painters to assist in the cleaning of paint rollers in a variety of locations.

The purpose of this invention is to assist in the cleaning of paint rollers in a simple controlled manner.

The advantages of this invention include:

DESIRABLE RESULTS

Thorough cleaning of paint rollers.

Increase in life expectancy of paint rollers.

Capability of cleaning paint rollers of different sizes without adjustment of the device.

SIMPLE SET-UP, CLEAN-UP AND STORAGE

Simple set-up procedures for the device.

Simple positioning and retention of the paint roller in the device.

Variety of possible set-up locations such as: exterior open locations, interior plumbing fixtures and any location reachable by liquid supply and discharge facilities.

Easy cleanup of device.

Detachable cover and spray shield for reduction of space needed for shipping and storage.

SIMPLE OPERATION OF THE DEVICE

Simple, reliable operation.

Unattended operation possibility.

Control of paint and cleaning liquid during cleaning operation.

SIMPLE MANUFACTURING

One piece construction of combination liquid dispensing, paint roller holding device.

Standard liquid inlet connector.

Detachable liquid spray shield.

Detachable Cover.

No moving parts.

No fasteners required.

PRACTICAL DESIGN

Stability of cleaning device caused by temporary weight of contained liquid and device configuration.

Automatic positioning of the paint roller into the device without removing from the paint roller assembly.

Automatic positioning of the paint roller for cleaning.

Automatic positioning of paint rollers of different sizes.

Automatic positioning of paint roller assemblies of different sizes and shaft configurations.

Unique use of spray jet locations, paint roller assembly pivot capabilities while in the device, shaft slots, pivot slots, pivot points and wedge shapes to secure paint roller in correct position without extraordinary means or knowledge.

Unique positioning of spray jets to counteract tendency of paint rollers to sag out of position because of weight added by addition of liquid.

Possibility of total plastic or non-ferrous construction to limit possibilities of rust, oxidation, rot or similar deterioration.

RAMIFICATIONS

While the above description contains many specifics, these should not be construed as limitations on the scope of the invention, but rather as an exemplification of one preferred embodiment thereof. Many other variations are possible. For instance:

1. The spray shield could be permanently attached to the liquid manifold.

2. The aeration of the spray jets could be eliminated.

3. The inlet recess could be deleted.

4. The spray jets could be of various configurations including round, slotted or continuous.

5. A multitude of spray jets could be included with some positioned to cause rotation of the paint roller and others to focus on wetting the paint roller for paint particle removal.

6. An integral or remote valve could be installed in union with the liquid inlet for liquid pressure and volume control.

7. An integral or remote timing device could be installed in union with the liquid inlet to control the time allotted for the cleaning process.

8. An attachment could be included to provide for the cleaning of paint rollers which have been detached from the paint roller assembly.

9. Various liquids under pressure could be used to dissolve and clean paint rollers of various paint materials.

10. A bottom cover for the spray shield could be provided with adequate liquid discharge capabilities to a temporary container or a remote location.

11. One shaft slot with its bottom configured to receive the holder shaft in various positions could be used in lieu of the use of several shaft slots.

12. Several devices could be used to detachably attach the spray shield to the liquid manifold including latches, pins and slots, hooks and the like.

13. Several devices could be used to attach the spray-shield to itself when in a coiled position including snaps, latches, straps, hooks and the like.

14. Magnets of appropriate strength could be introduced intothe design as a method of holding the paint roller shaft in the correct position during the paint roller cleaning process.

15. The design of the sides of the shaft slots could be engineered such that the introduction of liquid pressure into the interior of the liquid manifold would expand the side or sides of the shaft slot and thus grip the paint roller shaft holding it in the correct position during the paint roller cleaning process.

16. The liquid manifold could be configured in a double walled tubular shape with the inner wall forming the spray shield. The interior space between the inner and outer walls could convey the liquid to several liquid spray jet locations and contain several shaft slot, pivot slot, and pivot point assemblies to receive several paint roller assembles for simultaneous cleaning.

17. Several cleaning devices can be connected together with the detachably attached spray shields for the purpose of cleaning several paint rollers at one time using standard liquid supply equipment and connections.

Accordingly, the scope of the invention should be determined not by the embodiments illustrated, but by the appended claims and their legal equivalents.

It should be noted that this invention is capable of cleaning any size of standard paint roller by merely placing the paint roller into the device without any special attachments or adjustments. The paint roller is held in the correct position for the cleaning process by gravity, friction and the leverage forces caused by the unique placing of the liquid spray jets in relationship to the paint roller. The paint roller is thoroughly cleaned by the impingement of a multitude of strategically placed aerated liquid spray jets and by the centrifugal forces created by the rotating paint roller. The device is stabilized during the operation by the temporary weight added to it by the volume of liquid contained in the liquid manifold. The spray jet apertures in the liquid manifold are automatically cleaned of residual liquid or paint by the negative air pressure created by the unused liquid as it departs from the liquid manifold via the liquid inlet connector when the liquid source is detached. When not in use it is possible to detach the spray shield portion of the device and wrap it around the liquid manifold portion to reduce the volume of space needed to store or package the device.

This invention, however, is not to be construed as limited to the particular forms disclosed herein since these are to be regarded as illustrative rather than restrictive.

What is claimed is:

1. A paint roller cleaning device comprised of:

a. a spray shield means which detachably attaches to a liquid manifold forming a hollow housing open at both ends;

b. said liquid manifold having a multitude of apertures allowing liquid spray jets facing the interior of said housing formed by said spray shield when detachably attached to said liquid manifold for spraying liquid upon said paint roller and a paint roller holder;

c. a liquid inlet connector means located at the perimeter of said liquid manifold for attaching a fluid source;

d. said liquid manifold conveying liquid to said apertures to cause said liquid spray jets;

e. said liquid manifold having shaft slots for receiving a holder shaft.

f. said shaft slots having a wedge shaped configuration at their bottoms;

g. said shaft slots joining pivot slots and the perimeter of said liquid manifold;

h. said pivot slots having a wedge shaped configuration at their bottoms;

i. said pivot slots joining said shaft slots and the perimeter of said liquid manifold within the shape formed by said spray shield when attached to said liquid manifold;

j. a cover means for closing the top opening of said spray shield having a hole for inspection of said paint roller;

2. The device of claim 1 wherein said liquid spray jets are positioned in a linear pattern along the length of the liquid manifold to spray liquid upon the entire length of said paint roller and cause rotation of said paint roller on said paint roller holder about said paint roller holder shaft.

3. The device of claim 1 wherein said liquid spray jets are positioned to oppose the gravitational forces of the weight of said paint roller to cause said paint roller assembly, when inserted into the device, to pivot about said pivot point in said pivot slot, thus forcing said holder shaft into said wedge shaped configuration at the bottom of said shaft slot.

4. The device of claim 1 wherein said liquid spray jets are aerated.

5. The device of claim 1 wherein said liquid manifold can be of one piece construction.

6. The device of claim 1 wherein said liquid manifold has an integral recess for the location of said liquid inlet connector, said recess being a depth to allow said liquid inlet connector to be contained within the imaginary line of the perimeter of said liquid manifold.

7. The device of claim 1 wherein said spray shield means can be detachably attached to said liquid manifold by sliding an enlarged edge means on each side of said spray shield into a groove means along the length of each side of said liquid manifold.

8. A paint roller cleaning device, comprising:

(a) a liquid manifold configured to retain a paint roller and convey a liquid from a connected liquid source to the surface of said paint roller.

(b) a sheet of material of a size to form a spray shield housing said retained paint roller, (c) said spray shield being joined to said liquid manifold by an attachment means and further including, (d) a liquid inlet connection means located at the perimeter of said liquid manifold for attaching a fluid source, and (e) said liquid manifold also having integral shaft slots for receiving a holder shaft, said shaft slots joining pivot slots and the perimeter of said liquid manifold.

9. The device of claim 8 wherein said pivot slots have a wedge shaped configuration at their bottoms.

10. The device of claim 8 wherein said pivot slots join said shaft slots and the perimeter of said liquid manifold within the shape formed by said spray shield when attached to said liquid manifold.

11. A paint roller cleaning device, comprising:

(a) a manifold that dispenses a liquid into a space defined by an attached spray shield; said manifold comprised of a pipe extending longitudinally, substantially within said shield and in communication with an enlarged chamber for containing a sufficient quantity of liquid for stabilizing the device, and, (b) a holder means to retain and position a paint roller so as to allow free rotation of said paint roller when struck by said liquid dispensed from said manifold.

12. The device of claim 11 where said spray shield comprises a sheet of material joined to said manifold by an attachment means.

* * * * *